United States Patent [19]

Schill et al.

[11] Patent Number: 4,937,936

[45] Date of Patent: Jul. 3, 1990

[54] METHOD FOR RETROFITTING A NOISE REDUCING FILTERS TO AN ELECTRICAL COUPLING CONNECTOR.

[75] Inventors: Rolf Schill, Mühlacker; Stapelfeldt, Remchingen, both of Fed. Rep. of Germany

[73] Assignee: Alcatel N.V., Amsterdam, Netherlands

[21] Appl. No.: 322,067

[22] Filed: Mar. 13, 1989

[30] Foreign Application Priority Data

Mar. 12, 1988 [DE] Fed. Rep. of Germany ..... 3808330

[51] Int. Cl.[5] ..... H01R 43/00

[52] U.S. Cl. ..... 29/854; 533/182; 439/620; 439/608

[58] Field of Search ..... 29/854; 439/608, 620; 333/182

[56] References Cited

U.S. PATENT DOCUMENTS

| | | | |
|---|---|---|---|
| 3,840,841 | 10/1974 | Clark | 333/182 X |
| 4,126,370 | 11/1978 | Nijman | 333/182 X |
| 4,600,262 | 7/1986 | Nieman et al. | 333/182 X |
| 4,729,743 | 3/1988 | Farrar et al. | 439/620 X |
| 4,746,310 | 5/1988 | Morse et al. | 439/620 |

FOREIGN PATENT DOCUMENTS

| | | | |
|---|---|---|---|
| 0091867 | 10/1983 | European Pat. Off. . | |
| 3702931 | 8/1988 | Fed. Rep. of Germany . | |
| 2394903 | 1/1979 | France . | |
| 2025158 | 1/1980 | United Kingdom . | |
| 2137436 | 10/1984 | United Kingdom | 439/608 |
| 2190548 | 11/1987 | United Kingdom | 439/608 |

*Primary Examiner*—Goldberg Howard N.
*Assistant Examiner*—C. J. Arbes
*Attorney, Agent, or Firm*—Spencer & Frank

[57] ABSTRACT

A method and components for retrofitting non-filtered plug-in connectors with filters. For this purpose, an internal thread is cut into the rear housing portion (8) of a type of plug whose housing (2) has a larger diameter at the rear than at the front. Then a filter element (capillary capacitor 16) is pushed onto the connecting pin (10) of the contact element (4) and over it a perforated metal grounding sheet (12) and the arrangement is fastened in the housing (2) by means of a threaded ring (14). Finally, the metal grounding sheet (12) is soldered to the outer coating of the capillary capacitor (16) and the inner coating of the latter is soldered to the connecting pin (10).

4 Claims, 1 Drawing Sheet

METHOD FOR RETROFITTING A NOISE REDUCING FILTERS TO AN ELECTRICAL COUPLING CONNECTOR.

BACKGROUND OF THE INVENTION

The invention relates to a method of retrofitting an electrical filter into a plug-in electrical connector of the type having an insulating body with at least one contact element including a connecting pin freely projecting at the rear of the connector body.

Plug-in connectors configured as male or female members each form one half of a plug-in connection as it is commercially available in a variety of standard embodiments offering a with variety of configurations, respect to the number of poles and the arrangement of the contact elements, particularly in the unfiltered configuration. These plug-in connections can therefore be manufactured economically in large numbers and can be sold relatively inexpensively.

In contrast thereto, prior art plug-in connectors equipped with integrated noise reducing filters are structurally complicated and thus considerably more expensive. However, such plug-in connectors are required to an increasing degree to discharge to ground undesirable noise signals from the electrical lines connected to the contact elements of the plug-in connections. This is done, for example, by way of a plate-shaped capacitor block which is penetrated by connecting pins that are in engagement with the contact elements as taught in European Patent No. (EP 0,091,867.B1)

SUMMARY OF THE INVENTION

It is the object of the invention to subsequently add filters in a simple manner to the plug-in connector of a commercially available plug-in connection originally without a filter and to provide a suitable method for this purpose. This is accomplished according to the invention by providing a filter element for insertion over the connecting member and a grounding member for connecting the ground of the filter element to the body of the housing and by threading the housing and providing a threaded ring screwable onto the housing for securing the grounding member and filter element thereto. Advantageous measures in the performance of the method can be found in the dependent claims.

Such plug-in connectors which are subsequently retrofitted and thereby converted into filter-equipped plug-in connectors are considerably less expensive than those available in the trade. Adaptation to the various pole configurations of the type of connector employed is possible in a very simple manner because it is merely necessary to change the perforation of the metal grounding sheet.

BRIEF DESCRIPTION OF THE DRAWINGS

The invention will now be described in greater detail with reference to embodiments thereof which are illustrated in the drawing. Wherein.

DETAILED DESCRIPTION

Figure 1:
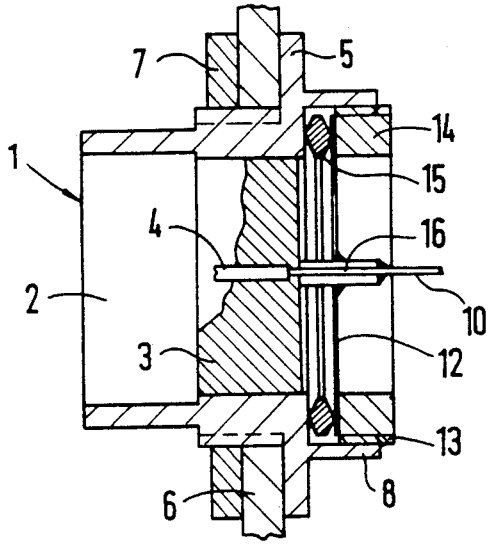
FIG. 1 is a longitudinal sectional view of a plug-in connector including a filter element fastened in a planar metal grounding sheet.
Figure 2:
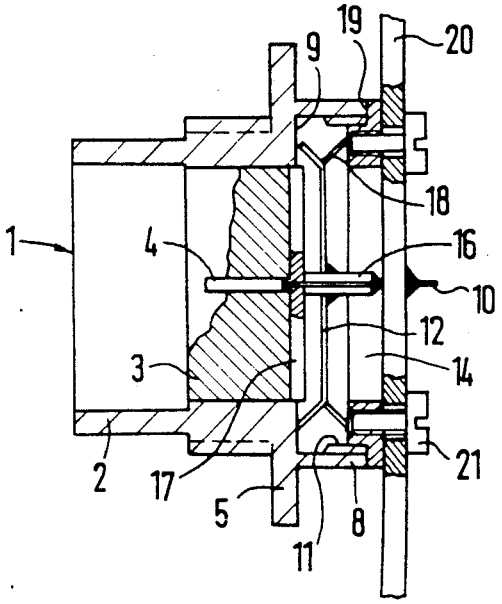
FIG. 2 is a partially sectional side view of a plug-in connector equipped with a feathered metal grounding sheet to which is fastened a printed circuit board.

In FIGS. 1 and 2 the plug-in connector as a whole is given the reference numeral 1. The commercially available, standardized embodiment is composed of an essentially cylindrical metal housing 2 in which is fastened an insulating body 3 equipped with at least one contact element 4 which is held in insulating body 3. The rear portion of housing 2 includes an outwardly directed flange 5 which serves as an abutment when plug-in connector 1 is pushed, for example through the corresponding opening of a mounting plate 6 to which it is fastened by means of a nut 7 which is screwed from the front onto housing 2.

The housing portion 8 continuing behind flange 5 has a larger diameter than the front housing portion including insulating body 3, thus forming an annular interior shoulder 9 (FIG. 2). The connecting pin 10 of a contact element 4 in the form of a socket or plug-in pin projects into the space defined by rear housing portion 8. Depending on the customer's desire, the length of connecting pin 10 is dimensioned so that it either ends in the space enclosed by rear housing portion 8 or, as shown in the illustrated embodiment, projects beyond it.

When a conventional plug-in connector 1 is retrofitted to become a model including filters, an internal thread 11 is initially cut into rear housing portion 8. In a separate step, a metal grounding plate 12 is punched out and a threaded ring 14 equipped with a mating external thread 13 is prepared as well as a contact ring 15. If contact element 4 is firmly embedded in insulating body 3, contact ring 15 is inserted first and then metal grounding sheet 12 is inserted into the rear housing portion; thereafter, connecting pin 10 is painted with soldering paste. Following that, a filter element, for example configured as capillary capacitor 16 with or without ferrite bead is pushed over connecting pin 10 until it comes to lie against insulating body 3. Finally, the arrangement is screwed tight by means of threaded ring 14, soldering paste is applied to metal grounding sheet 12 and the latter is soldered to the outer coating of capillary capacitor 16 and the inner coating at the rear end of the capillary capacitor is soldered to connecting pin 10 of contact element 14 projecting from it.

The rear face of threaded ring 14 is provided with slots for the attachment of a screw driver, while the frontal face is plane. The metal grounding sheet 12 in the form of a plate is also planar. In contrast thereto, contact ring 15 preferably has the cross section of a rhombus with flattened edges in the circumferential direction and sharp edges in the axial direction. Therefore, screwing in of threaded ring 14 causes metal grounding sheet 12 to be pressed against the sharp-edged rear face of contact ring 15 and the sharp-edged frontal face of the latter is pressed against the inner shoulder 9 of housing 2. In this way, a good electrical ground contact is established between housing 2 and capillary capacitor 16. In a simpler embodiment of plug-in connector 1, as illustrated in FIG. 2 contact ring 15 may be omitted.

The earlier described plug-in connector 1 can be obtained with contact elements 4 which are firmly anchored in insulating body 3 as well as with contact elements which are subsequently inserted in a self-locking manner into contact chambers of prefabricated insulating bodies 3. In the latter case, it is appropriate, in order to avoid mechanical stresses that could act on capillary capacitors 16, to first push a holding plate 17 as illustrated in FIG. 2 punched out of an insulating plate over connecting pin 10 until it is stopped at insulating body 3 before capillary capacitors 16 are installed. Depending on the number of contact elements 4 and their pole configuration, holding plate 17 is provided with perforations, each accommodating one connecting pin 10 in a press fit. Metal grounding sheet 12 is also provided with holes corresponding to the pole configuration of contact elements 4; the diameter of these holes is somewhat larger than capillary capacitors 16.

FIG. 2 depicts a modified metal grounding sheet 12. In this metal grounding sheet 12, the outer edge is feathered, that is, punched out to have cut-out resilient tongues 18 which are bent out of the plane of the sheet metal alternatingly obliquely forward and obliquely rearward. In this way, one part of resilient tongues 18 comes to lie against the internal shoulder 9 of housing 2 and the other part against threaded ring 14. In order to prevent resilient tongues 18 from being pressed flat, threaded ring 14 is provided at its rear with an outwardly oriented flange 19 which limits the screw-in depth and which at its rear face advisably terminates flush with the outer surface of rear housing portion 8. If connecting pins 10 of contact elements 54 are sufficiently long, an appropriately perforated printed circuit board 20 may be placed from the rear onto plug-in connector 1 and may be fastened to it by means of screws 21. Several threaded bores are cut into threaded ring 14 for this purpose. Metallized shielding faces on printed circuit board 20 can thus be electrically connected with housing 2 by means of screws 21 and threaded ring 14 and are at ground potential in a grounded housing.

We claim:

1. A method of retrofitting an electrical filter to a commercially available plug-in-electrical connector with at least one contact element held therein and fastened in a housing, the contact element including a connecting pin which freely projects at one end of said insulating body into an opening formed by one end of said housing, the method comprising the steps of:

(a) cutting a threaded into said one end of said housing;

(b) providing a filter element;

(c) providing a metal grounding sheet having a perforation corresponding to the outer diameter of said filter element;

(d) providing a threaded ring having a thread matching said thread of said one end of said housing;

(e) inserting said metal grounding sheet into said opening and into contact with said one end of said housing;

(f) painting said connecting pin with soldering paste;

(g) pushing said filter element onto said connecting pin up to said insulating body;

(h) screwing said threaded ring onto said one end of said housing to secure said metal grounding sheet in said housing;

(i) applying solder paste to said metal grounding sheet;

(j) producing a solder connection between said metal grounding sheet and a first part of said filter element; and (k) producing a solder connection between a second part of said filter element and said connecting pin.

2. A method according to claim 1, wherein said opening is cylindrical, said threads cut into said one of said housing art cut as internal threads on the inner surface of said cylindrical opening, and said threads on said threaded ring are external.

3. A method according to claim 1, comprising the further step of:

inserting a contact ring into said opening between said insulating member and said grounding sheet.

4. A method according to claim 1, further comprising the step of:

inserting a holding plate having an opening corresponding to said connecting pin into said opening such that said connecting pin extends through said hole, said holding plate positioned against said insulating body.

* * * * *

UNITED STATES PATENT AND TRADEMARK OFFICE

CERTIFICATE OF CORRECTION

PATENT NO. : 4,937,936

DATED : July 3rd, 1990

INVENTOR(S) : Rolf SCHILL et al.

It is certified that error appears in the above-identified patent and that said Letters Patent is hereby corrected as shown below:

Title page:

Under [54], in the second line, the second word of the title should read -- FILTER --.

Under [75], in the first line, "Stapelfeldt" should read -- Rolf Stapelfeldt --.

Signed and Sealed this

Seventeenth Day of September, 1991

*Attest:*

*Attesting Officer*

HARRY F. MANBECK, JR.

*Commissioner of Patents and Trademarks*